US009386647B2

(12) United States Patent
White et al.

(10) Patent No.: US 9,386,647 B2
(45) Date of Patent: Jul. 5, 2016

(54) DIGITAL CONTROL METHOD FOR LOW OUTPUT DIMMING OF LIGHT EMITTING DIODE (LED) DRIVERS

(71) Applicant: General Electric Company, Schenectady, NY (US)

(72) Inventors: Anthony Steven White, Parma, OH (US); Nina Rose Scheidegger, Cleveland, OH (US); Gang Yao, Twinsburg, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/519,701

(22) Filed: Oct. 21, 2014

(65) Prior Publication Data

US 2016/0113084 A1 Apr. 21, 2016

(51) Int. Cl.
*H05B 33/08* (2006.01)

(52) U.S. Cl.
CPC ..... *H05B 33/0845* (2013.01)

(58) Field of Classification Search
CPC ..... H05B 33/0845
USPC ..... 315/307
See application file for complete search history.

(56) References Cited

U.S. PATENT DOCUMENTS

2011/0068704 A1* 3/2011 McKinney ..... H05B 33/0815 315/210
2013/0163287 A1* 6/2013 Pal ..... H02M 3/33515 363/16
2013/0234617 A1* 9/2013 Sanghvi ..... H05B 33/0842 315/224
2014/0265935 A1* 9/2014 Sadwick ..... H05B 33/0848 315/307
2014/0300274 A1* 10/2014 Acatrinei ..... H05B 33/0815 315/85
2015/0264769 A1* 9/2015 Jelaca ..... H05B 33/0845 315/206

FOREIGN PATENT DOCUMENTS

WO 2011024101 A1 3/2011
WO 2014022351 A2 2/2014

OTHER PUBLICATIONS

International Search Report and Written Opinion issued in connection with Application No. PCT/ US2015/060251 on Apr. 26, 2016.

* cited by examiner

*Primary Examiner* — Dylan White
(74) *Attorney, Agent, or Firm* — GE Global Patent Operation; Peter T. DiMauro

(57) ABSTRACT

A method for mitigating visual fluctuation of light output at low pulse width modulation levels is disclosed. The method comprises at least the step of comparing the percent change of a previously applied input voltage value to the pulse width modulation output.

18 Claims, 3 Drawing Sheets

DIGITAL CONTROL METHOD FOR LOW OUTPUT DIMMING OF LIGHT EMITTING DIODE (LED) DRIVERS

FIELD OF THE INVENTION

The present invention relates generally to driver circuits for light emitting diode (LED) drivers. More particularly, the present invention relates to dimming driver circuits for LED devices.

BACKGROUND OF THE INVENTION

The market for LED lamps has grown exponentially as residential and commercial consumers make the change, from incandescent and halogen bulbs, to LED lighting. The typical reasons are better power efficiency and much longer lifetime. In addition to the benefit of saving energy, consumers also want the same features in LED lamps that are provided for the halogen bulbs; specifically, the ability to dim the light because it provides the desired ambience.

Technically, an LED is generally understood as a semiconductor device that generates light when electrical energy is applied to the device. Multiple LEDs can be formed into an array and powered as a unit.

LEDs are voltage sensitive devices. An LED must be supplied with a voltage that is above a threshold voltage and a current that is below the rating of the particular LED device. Generally, the current that is supplied to an LED is dependent exponentially on the voltage, referring to the Shockley diode equation. A small change in voltage can cause a large change in current. If the maximum voltage rating is exceeded by a small amount, the current rating can be exceeded by a large amount, potentially damaging the LED.

An LED driver or driving circuit is a type of power conversion circuit that delivers constant current instead of constant voltage. The typical LED driving circuit, or driver device, will convert a line voltage alternating current ("VAC") to a direct current ("DC").

LED dimming solutions generally include constant current reduction ("CCR") or pulse-wave modulation (PWM) dimming. Constant current dimming generally involves linear adjustment of the current through the LEDs. Pulse-wave modulation will drive the LEDs at one current level, but will turn the LEDs on or off at a frequency that is generally greater than 120 Hz.

Dimming LED drivers often use 0-10 V control signals to control the dimming functions. Namely, the control signal varies between zero and ten volts. As a result, the controlled lighting scales its output so that at 10 V, the controlled light operates at 100% of its potential output, and at 0 V it operates at 0% output (i.e., "Off") or a minimum dim level (i.e., 10%)

In the assignment of pins on a microchip in a PWM dimming solution, the normal function of the LED driver is to read the 0-10 volt analog input voltage on the microchip and assign it as a digital value representing the analog voltage reading. The value is then set as the PWM reference and used to adjust the pulse width modulation output of the microchip. Thus, the PWM reference is then used to control the light output of the luminaire attached to the driver.

However, this methodology of measuring the output and then adjusting the pulse width modulation output (PWM) accordingly can cause problems in the lower levels of PWM output in relation to the light output. When the PWM output is very low, the human eye can detect very small changes in light level (i.e., 1 mA). Thus, fluctuation or flickering of light can be visually perceived by the human eye at low pulse width modulation levels.

Although very complicated and advanced digital filters have been developed in digital dimming applications, the flickering problem can still persist at a difference between the digital output signal values of 151 and 150.999. The flickering can still be seen due to the fact that through the binary methods the value of 150.999 becomes 150. This problem cannot, however, be fixed through adjusting to a rounding methodology, such as floor or ceiling based rounding, which rounds to the nearest integer either up or down. Therefore, the flickering problem is still prevalent at the digital output signal values between 150 to 150.001.

To address this problem, more processor intensive methods have been developed by some manufacturers. The drawback of these methods is that the implementation requires too much memory and thus requires a more expensive microchip. Another disadvantage is that these methods do not account for small average changes of the 0-10V line, which will cause changes of the PWM output.

Therefore, there remains a need for a low voltage solution to mitigate flicker. There also remains a need for system and method that provides a light load on the CPU while eliminating visual fluctuation of light output at low pulse width modulation levels.

SUMMARY OF THE INVENTION

In certain embodiments, a method for mitigating visual fluctuation of light output at low pulse width modulation levels is disclosed. The method comprises the step of comparing the percent change of a previously applied input voltage value to the pulse width modulation output.

In certain embodiments, the method comprises the steps of measuring an input voltage value across input/output pins of a microcontroller; calculating a reference voltage ($V_R$) by the following equation:

$$((V_{in}/V_{DD})*1023)V_{DD}$$

wherein "$V_{in}$" denotes the input voltage, "$V_{DD}$" denotes the voltage of the power supply;

calculating a percent change between the measured input voltage value and a reference pulse width modulation value; and generating an error rejection code to ignore the measured input voltage value when the percent change is determined within a predetermined range.

In certain embodiments, a system for mitigating visual fluctuation of light output at low pulse width modulation levels is disclosed. The system comprises an LED driver and a plurality of input/output pins through which data signals are transferred into and out of a microcontroller. A controller is coupled to the LED driver and configured to provide pulse width modulation signal to the LED driver through control leads to control the light output of at least one light source attached to the LED driver. The LED driver is configured to read an input voltage value across input pins of the microcontroller and calculate a reference voltage ($V_R$) by the following equation $$((V_{in}/V_{DD})*1023)V_{DD}$$

wherein "$V_{in}$" denotes the input voltage, "$V_{DD}$" denotes the voltage of the power supply.

Additional features and advantages, as well as the structure and operation of various embodiments, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

Figure 1:
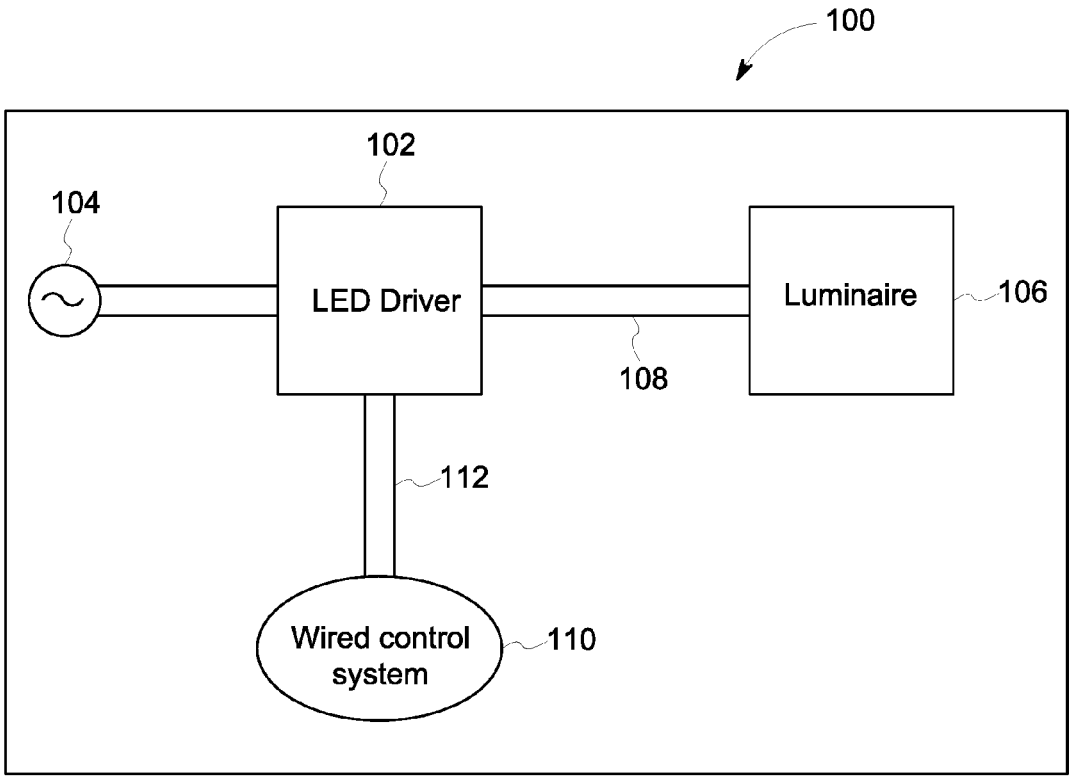
FIG. 1 is a block diagram of the major components of a digital control system used with LED drivers in accordance with the present invention.

The present invention may take form in various components and arrangements of components, and in various process operations and arrangements of process operations. The present invention is illustrated in the accompanying drawings, throughout which, like reference numerals may indicate corresponding or similar parts in the various figures. The drawings are only for purposes of illustrating preferred embodiments and are not to be construed as limiting the invention. Given the following enabling description of the drawings, the novel aspects of the present invention should become evident to a person of ordinary skill in the art.

DETAILED DESCRIPTION OF VARIOUS EMBODIMENTS

The following detailed description is merely exemplary in nature and is not intended to limit the applications and uses disclosed herein. Further, there is no intention to be bound by any theory presented in the preceding background or summary or the following detailed description.

A system and method of controlling flickering at low level voltages with very minimal CPU usage is provided. In at least one aspect, the present invention provides a digital control method for use in applications with LED drivers to remove any visible changes in light output during low current output dimming. In various embodiments, the system and method addresses the existence of visual fluctuations of light output at low PWM levels. In at least one aspect, the device and method compares the percent change of a previously applied input voltage value to the PWM output.

An exemplary system 100 for a dimming LED driver circuit is illustrated in FIG. 1. In various embodiments, the system 100 provides an LED lighting dimming solution that involves pulse width modulation. Various aspects of the disclosed embodiment implement a low cost solution, without the need for a more expensive microchip, wherein there is no decrease in visual performance during the transition between light levels.

In FIG. 1, the system 100 includes an LED driver 102 electrically coupled with an AC power source 104, an LED luminaire 106, and a wired control system 110. The LED driver 102 is operable according to the power provided from the AC power source 104 to drive one or more LED luminaires 106. Although the example in FIG. 1 depicts an LED luminaire as the lighting source, in various embodiments, the lighting source can comprise any suitable type of LED application or device. While only a single LED luminaire is illustrated in FIG. 1, in alternate embodiments the system 100 can include any suitable number of lighting sources.

The exemplary driver 102 can be equipped with a main power conversion system (not shown), where the power system is operatively coupled with the AC source 104 for receiving AC input power. The LED driver 102 can include or be coupled to suitable AC power rectification and conversion, to convert the AC input power to provide rectifier DC output power. The LED driver 102 can further include an output power stage operatively coupled with the rectifier output terminals to convert the rectifier DC output power to provide driver output power 108 to the LED luminaire 106.

One or more LED luminaires 106 prepared according to the present teachings can be subjected to dimming control, a lighting pattern control, time schedule control, and/or daylight interlocking control by utilizing control input signals through dimming a wired control system 112 in order to subject the LED luminaires 106 to a lighting control system using dimming and switching circuits, for example, wired control system 112 such as individual wiring system, personal wiring multiplex system, telephone line system, power line carrier system and optical fiber system and wireless control systems such as electric wave control system, light control system, ultrasonic control system and acoustic control system.

The wired control system 112 can include a dimming interface circuitry (not shown in FIG. 2) that provides a pulse width modulated signal PWM, which is used to adjust the brightness of illumination of the LED luminaire 106. The PWM can be used to control the amount of power delivered to the LED luminaire 106. The dimming interface circuity generates 0 Volt to 10 Volt dimming control signals through dimming wires 112 based on the on and off position of the switches (not shown) to modulate light output from the LED luminaire 106. The ratio of on time to the off time of the switches determines the LED brightness.

Figure 2:
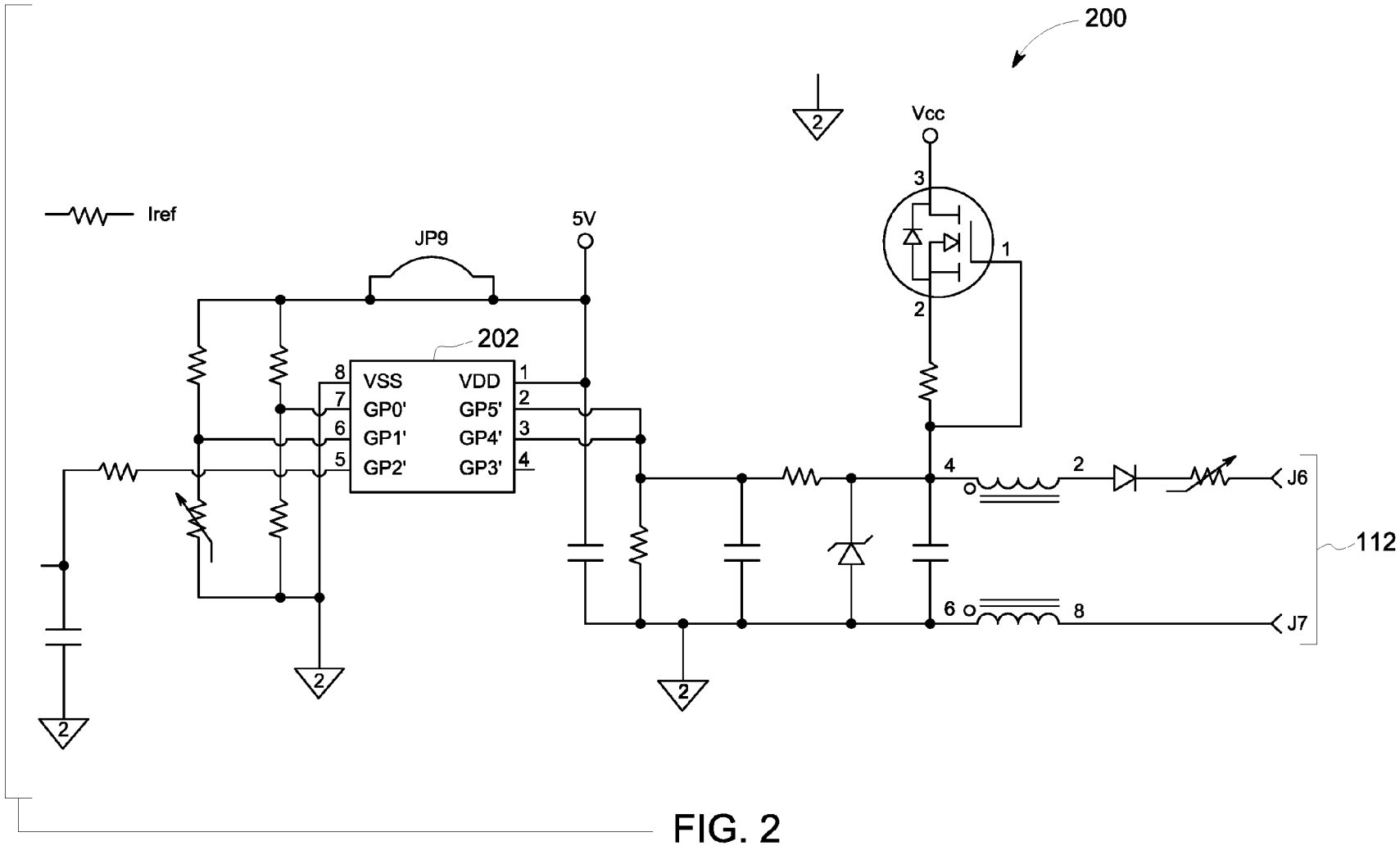
FIG. 2 illustrates a circuit diagram of a portion of the digital control system, which includes a microcontroller in accordance with the present invention.

FIG. 2 illustrates a 0-10 Volt input circuit 200 including a microcontroller 202, which comprises a plurality of input/output (I/O) pins. In general, the microcontroller 202 is a small computer on a single integrated circuit containing a processor core, memory, and programmable input/output peripherals. Microcontrollers are designed for embedded applications. The I/O pins are software configurable to either an input or an output state. When the I/O pins are configured to an input state, they are often used to read sensors or external signals. When they are configured to the output state, the I/O pins can drive external devices such as LED luminaire 106.

In FIG. 2, the circuit 200 generates dimming control signals via the control leads (dimming wires 112) when the switches (not shown) are switched on and off. The analog voltage between 0-10 Volts is applied to the dimming wires 112. The voltage across dimming wires 112 is measured on Pin 3 of the microcontroller 202. This voltage measurement is then compared in the firmware to a threshold value. This comparison measurement is used to determine whether a code should be activated to assist with the low output dimming. The processor of the microcontroller 202 may execute code stored in the memory to provide control functionality and to process information to reject error from the driver's standpoint on the microcontroller. The code can be used to reject the subtle changes to the voltage at Pin 3 ($V_{in}$). Thus, an error rejection code can be facilitated using the processor using computer-executable instructions running on the processor.

If a determination is made to activate the code, the microcontroller 202 sets the reference voltage on Pin 5 based on the measurement. The reference voltage will then be used to set the output current of the driver.

It should be noted that the details of the additional component of circuit 200 in FIG. 2 are not relevant here and will not be described further herein.

In operation, circuit 200 implements a method that rejects the subtle changes to the voltage ($V_{in}$) at Pin 3. Thus, a control method to reject errors from the driver's standpoint is provided. Initially, the voltage value across the pins of the microcontroller 202 is measured and assigned to calculate the reference voltage. The reference voltage ($V_R$) can be expressed by the following equation:

$$((V_{in}/V_{DD})*1023)V_{DD}$$

In the formula above, "$V_{in}$" denotes the input voltage at Pin 3, "$V_{DD}$" denotes the voltage of the power supply at Pin 1. Typically, the reference voltage is 5 Volts.

If the calculated reference voltage value is the first measured value during the start-up of the driver 102 (FIG. 1), the first measured voltage value is compared to an initial value of zero. This initial comparison value will then be used to set the reference PWM value to the initial $V_{in}$ value. Once another voltage value is measured across the pins by the microcontroller 202, the percent change between the measured voltage value and the reference PWM value is calculated. If the percent change between the two values is less than a specified percent, the Vin is ignored and the PWM value remains constant. Thus, the method rejects the subtle changes by ignoring the PWM such that the PWM value remains constant.

Figure 3:
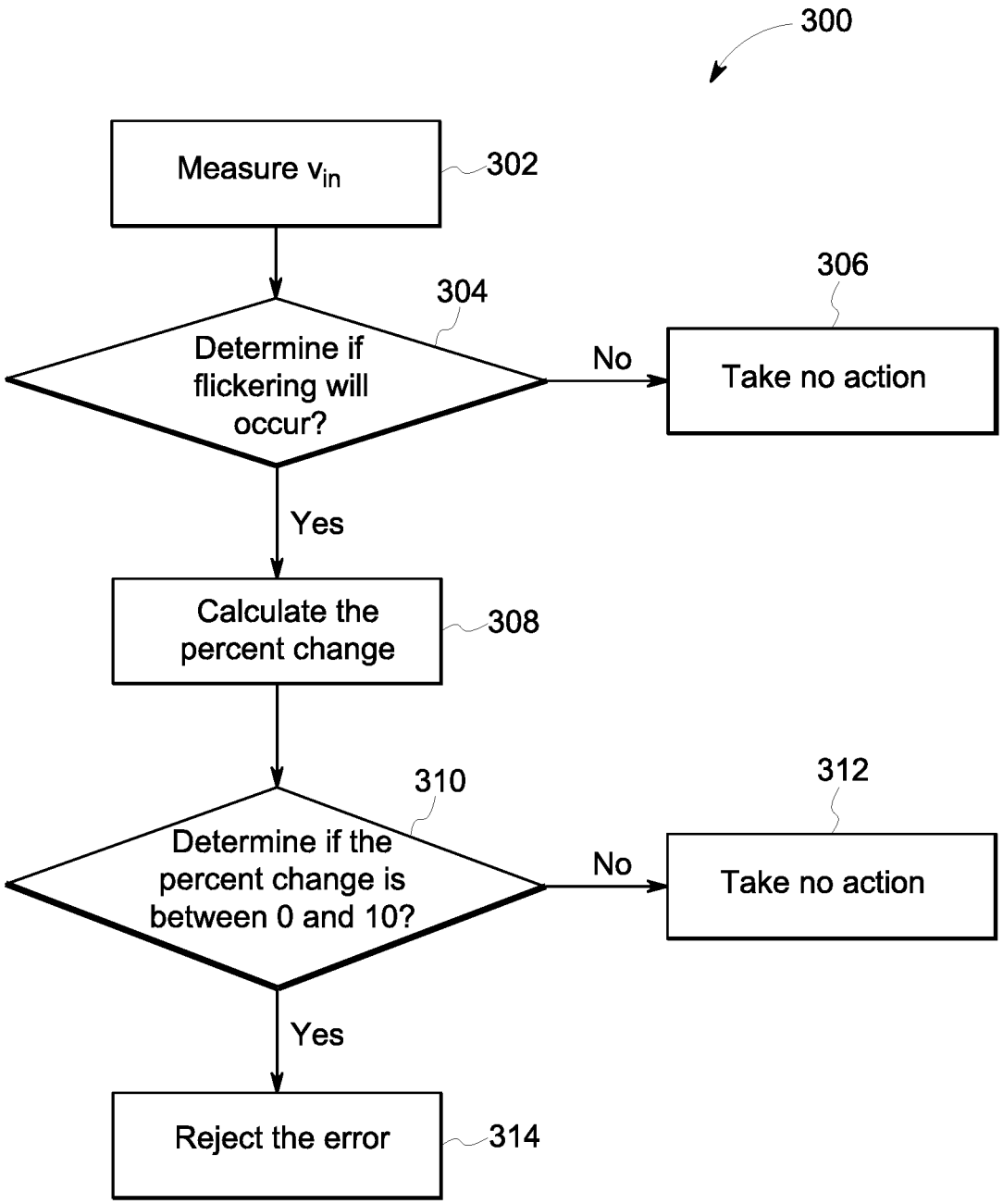
FIG. 3 is a flowchart of an exemplary method of practicing an embodiment of the present invention.

FIG. 3 is a flowchart of a method 300 of rejecting errors. The flowchart illustrates the functional information one of ordinary skill in the art requires to fabricate circuits and/or to generate computer software/firmware to perform the processing required in accordance with the embodiments. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order.

Further, while FIG. 3 illustrates various operations, it is to be understood that not all of the operations depicted in FIG. 3 are necessary for other embodiments to function. Indeed, it is fully contemplated herein that in other embodiments of the present invention, the operations depicted in FIG. 3, and/or other operations described herein, may be combined in a manner not specifically shown in any of the drawings, but still fully consistent with the present invention. Thus, claims directed to features and/or operations that are not exactly shown in one drawing are deemed within the scope and content of the present invention.

More particularly, in method 300 of FIG. 3, a pulse width modulation signal is received from the dimming interface circuitry in Step 302. In Step 304, a comparison is made to determine whether the input voltage ($V_{in}$) is below a predetermined threshold to detect conditions that would generate flickering. When the input voltage ($V_{in}$) exceeds the threshold, the method proceeds to Step 306 where no further action is taken and returns a value of true.

When the input voltage ($V_{in}$) is below the threshold in Step 304, the method proceeds to Step 308 to calculate the percent change between the measured value and the reference PWM value. In Step 310, a comparison is made to determine whether the percent change of the measured value and the reference PWM is between 0 and 10, taking the absolute value.

At Step 312, when the percent change does not fall within the range between 0 and 10, the method proceeds to Step 312 where no further action is taken and returns a value of true. At Step 314, if the percent change is between 0 and 10, the method will reject the error, and the pulse width modulation value remains at a constant level, thus, cancelling any flickering.

The methods and systems described herein are not limited to a particular hardware/software/firmware configuration, and may find applicability in many computing or processing environments. The methods and systems may be implemented in hardware or software, or combinations thereof. The methods and systems may be implemented in one or more computer programs, where a computer program may be understood to include one or more processor executable instructions.

The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data.

The input and/or output devices may include one or more of the following: Random Access Memory (RAM), Redundant Array of Independent Disks (RAID), floppy drive, CD, DVD, magnetic disk, internal hard drive, external hard drive, memory stick, memory chip, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

References to "a microprocessor" and "a processor" and "a controller", or "the microprocessor" and "the processor" and "the controller", may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" or "controller" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application.

Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

As used in any embodiment herein, a "circuit" or "circuitry" may comprise, for example, singly or in any combination, hardwired circuitry, programmable circuitry, state machine circuitry, and/or firmware that stores instructions executed by programmable circuitry.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

Alternative embodiments, examples, and modifications which would still be encompassed by the invention may be made by those skilled in the art, particularly in light of the foregoing teachings. Further, it should be understood that the terminology used to describe the invention is intended to be in the nature of words of description rather than of limitation.

Those skilled in the art will also appreciate that various adaptations and modifications of the preferred and alternative embodiments described above can be configured without departing from the scope and spirit of the invention. Therefore, it is to be understood that, within the scope of the appended claims, the invention may be practiced other than as specifically described herein.

What is claimed is:

1. A method for mitigating visual fluctuation comprising:
measuring an input voltage value across input/output pins of a microcontroller;
determining a reference voltage ($V_R$) as a function of an input voltage ($V_{in}$) and a power supply voltage ($V_{DD}$);
calculating a percent change between the measured input voltage value and a reference pulse width modulation value; and
generating an error rejection code to ignore the measured input voltage value when the percent change is determined within a predetermined range.

2. The method of claim 1, wherein the pulse width modulation value remains constant when the percent change is determined within the predetermined range; and
wherein $V_R=((V_{in}/V_{DD})*1023)V_{DD})$.

3. The method of claim 1, wherein the error rejection code is activated to assist with low output dimming.

4. The method of claim 1, wherein the error rejection code is implemented to reject subtle input voltage variations at one or more input pins of the microcontroller.

5. The method of claim 1, wherein $V_R$ is set on a predetermined output pin of the microcontroller when the error rejection code is activated and $V_R$ is used to set the output current of the LED driver.

6. A dimming circuit comprising:
a controller configured to:
measure an input voltage value across input/output pins of a microcontroller;
calculate a reference voltage ($V_R$) by the following equation $$(V_R)=((V_{in}/V_{DD})*1023)V_{DD}$$

wherein "$V_{in}$" denotes the input voltage, "$V_{DD}$" denotes the voltage of the power supply;
calculate a percent change between the measured input voltage value and a reference pulse width modulation value; and
generate an error rejection code to ignore the measured input voltage value when the percent change is determined within a predetermined range.

7. The circuit of claim 6, wherein the controller maintains the pulse width modulation value constant when the percent change is determined within the predetermined range.

8. The circuit of claim 6, wherein the controller activates the error rejection code to assist with low output dimming.

9. The circuit of claim 6, wherein the controller implements the error rejection code to reject subtle input voltage variations at one or more input pins of the microcontroller.

10. The circuit of claim 6, wherein the controller sets $V_R$ on a predetermined output pin of the microcontroller when the error rejection code is activated and the reference voltage $V_R$ is used to set the output current of the LED driver.

11. A system comprising:
a plurality of input/output pins through which data signals are transferred into and out of a microcontroller;
a light emitting diode (LED) driver;
a controller coupled to the LED driver and configured to provide pulse width modulation signal to the LED driver through control leads to control the light output of at least one light source attached to the LED driver; and
the LED driver is configured to read an input voltage value across input pins of the microcontroller and calculate a reference voltage ($V_R$) by the following equation $$(V_R)=((V_{in}/V_{DD})*1023)V_{DD}$$

wherein "$V_{in}$" denotes the input voltage, "$V_{DD}$" denotes the voltage of the power supply.

12. The system of claim 11, a percent change between the measured input voltage value is calculated.

13. The system of claim 12, wherein an error rejection code is generated to ignore the measured input voltage value when the percent change is determined within a predetermined range.

14. The system of claim 13, the pulse width module value is maintained constant when the percent change is determined within a predetermined range.

15. The system of claim 13, wherein the error rejection code is activated to assist with low output dimming.

16. The system of claim 13, wherein the error rejection code is implemented to reject subtle input voltage variations at one or more input pins of the microcontroller.

17. The system of claim 13, wherein $V_R$ is set on a predetermined output pin of the microcontroller when the error rejection code is activated and $V_R$ is used to set the output current of the LED driver.

18. The system of claim 11, wherein the at least one light source comprises an LED luminaire.

* * * * *